United States Patent [19]

DeCaro

[11] Patent Number: 4,800,601

[45] Date of Patent: Jan. 31, 1989

[54] DEVICE FOR SPREADING AND HANGING THE HEAD OF A HAMMOCK

[76] Inventor: Thomas J. DeCaro, Green Lantern Station, 2901 McGehee Rd., Montgomery, Ala. 36111

[21] Appl. No.: 167,191

[22] Filed: Mar. 11, 1988

[51] Int. Cl.[4] ..... A45F 3/22

[52] U.S. Cl. ..... 5/123; 5/122; 24/128; 256/23; 403/331

[58] Field of Search ..... 5/123, 122, 121, 120, 5/190; 403/331; 272/65; 256/23; 24/128

[56] References Cited

U.S. PATENT DOCUMENTS

| | | |
|---|---|---|
| 269,876 | 1/1883 | Nelson . |
| 271,767 | 2/1883 | Bates . |
| 312,988 | 2/1885 | Ewing . |
| 384,728 | 6/1888 | Thomas . |
| 964,452 | 7/1910 | Palmer . |
| 996,028 | 6/1911 | Palmer . |
| 1,214,805 | 2/1917 | Lowy . |
| 1,814,579 | 7/1931 | Ames . |
| 2,062,069 | 1/1936 | Powers . |

OTHER PUBLICATIONS

Town & Country Magazine Advertisement, Mar., 1988.

*Primary Examiner*—Alexander Grosz
*Attorney, Agent, or Firm*—Bacon & Thomas

[57] ABSTRACT

The head of a hammock is maintained in a spread condition and attached to its support ropes by an extruded elongate member having open and closed longitudinal slots within which the ends of the hammock support ropes and the corresponding head of the hammock are respectively secured, with the transverse profile of each slot being of a substantially C-shaped configuration.

12 Claims, 2 Drawing Sheets

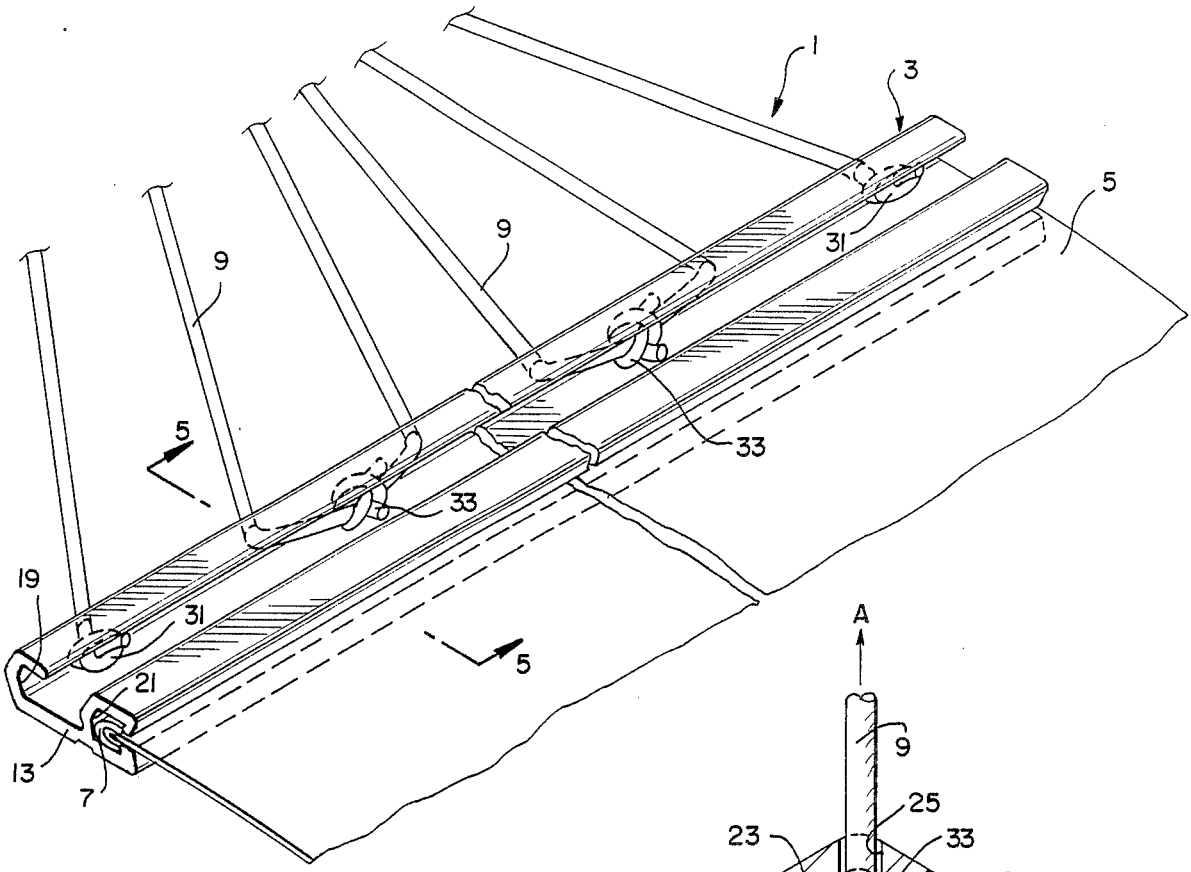
FIG 4
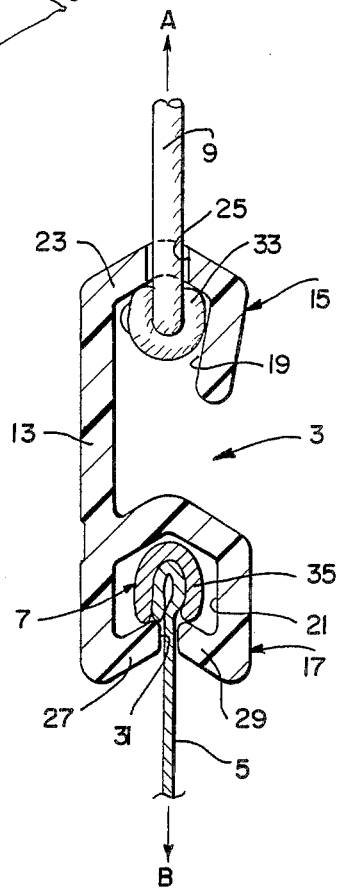
FIG 5
FIG 3
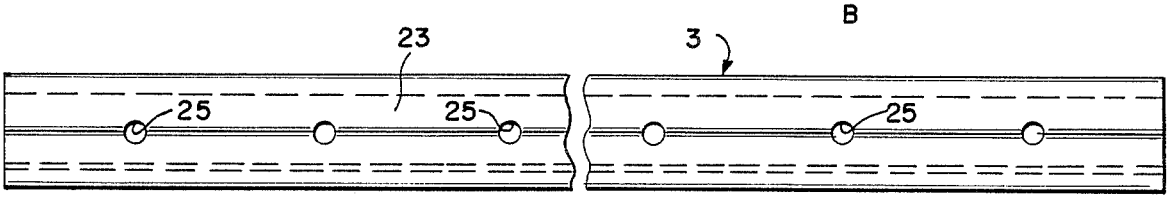

DEVICE FOR SPREADING AND HANGING THE HEAD OF A HAMMOCK

BACKGROUND OF THE INVENTION

1. Field of the Invention

The present invention generally involves the field of technology pertaining to hammocks and similar types of structures. More particularly, the invention relates to an improved device for both attaching the head of a hammock to its associated support ropes and maintaining the head in a spread condition to prevent its collapse when weight is applied to the bed of the hammock.

2. Description of the Prior Art

A conventional hammock is generally in the form of a rectangular-shaped bed formed from flexible material, such as a sheet of woven fabric. The opposite heads of the hammock are each attached to a plurality of support ropes which, in turn, are converged for a single-point attachment to a suitable support. In order to prevent the heads of the hammock from collapsing inwardly when weight is applied to the bed, a rigid spreader bar is used to maintain each head in a stretched or spread condition.

A typical hammock head is formed from a sewn hem which is provided with a plurality of spaced metal grommets through which the ends of the support ropes are looped and secured. The spreader bar may be disposed in its position of use by, alternatively, wedging the opposite ends of the bar between the outermost support ropes, inserting the support ropes through a corresponding number of spaced apertures formed in the bar, or inserting the bar into a longitudinal slot formed in the hem of the head. These known arrangements require separate manufacturing procedures for forming the diffrrent required structures for attaching the support ropes to the hammock head and maintaining the head in a spread condition.

The prior art has also recognized the advantage of utilizing a single device for both attaching the head of the hammock to its support ropes and maintaining the head in a spread condition. These devices have generally been in the form of modified spreader bar structures which are somewhat complicated in configuration, difficult to manufacture and limited in application of use.

SUMMARY OF THE INVENTION

It is an object of the present invention to provide an improved device for both attaching a hammock head to its associated support ropes and maintaining the head in a spread condition.

It is another object of the invention to provide a combined spreader bar and hanger device which is of simple construction, economical to manufacture and capable of different applications of use.

It is a further object of the invention to provide an improved device for attaching a hammock head to its support ropes, wherein the device is easy to install, capable of sustaining heavy tension loads and has enhanced longevity in use under adverse environmental conditions.

These and other objects of the invention are realized by providing a device in the form of an elongate member that is preferably integrally extruded from plastic material. The member is provided with a pair of parallel longitudinal slots, one being of an open C-shaped configuration and the other being of a substantially closed C-shaped configuration. The open slot includes a longitudinal rear wall that is provided with a plurality of spaced apertures through which the ends of the support ropes are received and knotted, with the knots being disposed within the slot. The closed slot includes a pair of inwardly directed longitudinal flanges which terminate to define a space therebetween having a width slightly less than the thickness of the material forming the hammock bed. The head of the hammock is slid longitudinally into the closed slot and secured therein against removal in the transverse direction since the spacing between the flanges is narrower than the thickness of the head.

Other objects, features and advantages of the invention shall become apparent from the following detailed description of a preferred embodiment thereof, when taken in conjunction with the drawings wherein like references characters refer to corresponding parts in the several views.

BRIEF DESCRIPTION OF THE DRAWINGS

FIG. 3 is a fragmentary top plan view of the invention;

FIG. 4 is a fragmentary perspective view depicting the underside of the invention in its installed position of use, particularly depicting the manner in which the ends of the support ropes are secured within the open slot and the manner in which the head is secured within the closed slot; and FIG. 5 is a cross-sectional view taken along the line 5—5 and in the direction shown in FIG. 4.

DETAILED DESCRIPTION OF THE PREFERRED EMBODIMENT

Figure 1:
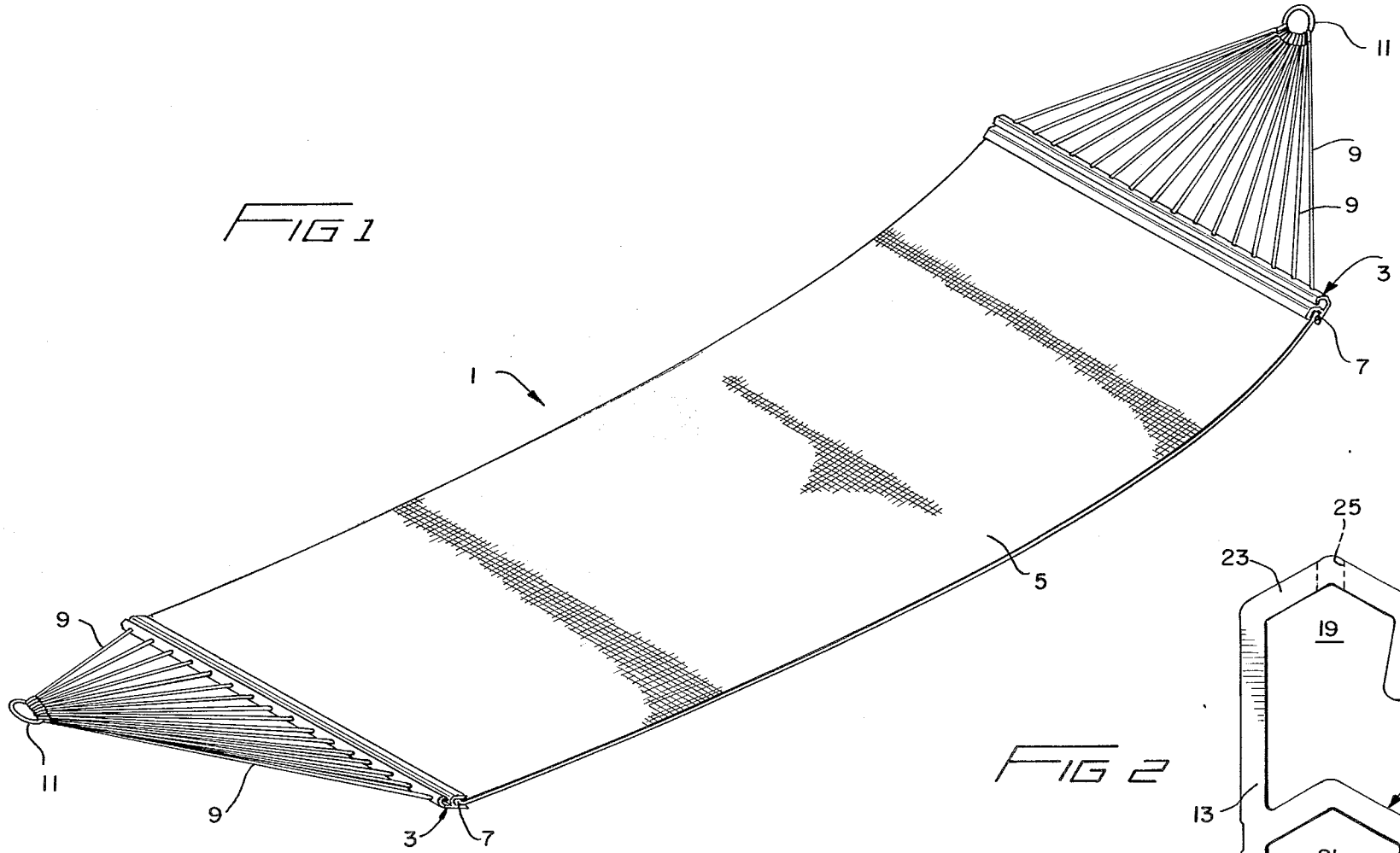
FIG. 1 is a perspective view of a hammock incorporating a preferred embodiment of the invention at each head of the bed for attaching the head to its corresponding support ropes and maintaining the head in a spread condition.

A hammock 1 is shown in FIG. 1 incorporating a device 3 according to a preferred embodiment of the invention at each end thereof. Hammock 1 is essentially defined by a bed 5 of rectangular configuration, with the opposed shorter sides thereof each provided with a thickened edge forming a head 7. Each head 7 is attached to a plurality of spaced support ropes 9 by means of device 3 in a manner to be hereinafter detailed. Support ropes 9 converge at each end of hammock 1 to a common metal ring 11, or similar device, for defining a point of attachment to an appropriate support (not shown). Bed 5 is generally formed of flexible material, preferably woven fabric of natural or synthetic fiber. Support ropes 9 are also preferably formed from natural or synthetic material.

As apparent from the configuration of hammock 1, when opposed rings 11 are attached to their respective supports and the weight of a user is applied to bed 5, tension is immediately imparted to support ropes 9, resulting in the tendency for heads 7 to collapse inwardly. As shall hereinafter be described, device 3 serves the dual function of providing a means for attaching each head 7 to its corresponding support ropes 9 and maintaining head 7 in a spread condition against inward collapsing when weight is applied to bed 5.

Figure 2:
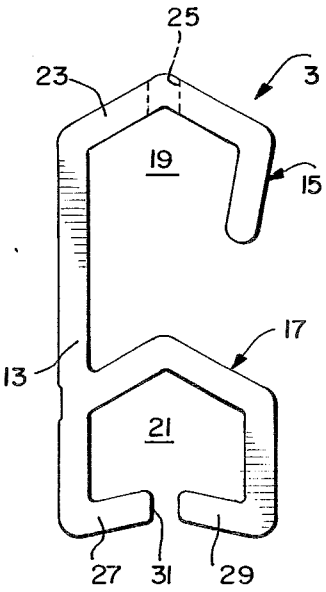
FIG. 2 is an end view of the invention showing the C-shaped transverse profile of the longitudinal open slot and the longitudinal closed slot.

With reference now to FIGS. 2 and 3, device 3 is shown to be in the form of an elongate member having a uniform transverse cross-sectional configuration along its entire length. Device 3 is preferably integrally molded, such as by conventional extrusion or injection molding technique, from appropriate plastic material, such as furniture grade polyvinylchloride (PVC). Other types of plastic material may also be used provided such material is capable of withstanding the physical loading and adverse environmental conditions under which device 3 is expected to be utilized. It is also conceivable that device 3 may be formed from extruded metal, such as aluminum, or the like.

The transverse profile of device 3 as shown in FIG. 2 is defined by a base section 13 on which are supported an open C-shaped section 15 and a substantially closed C-shaped section 17 which face the same direction. As is apparent, open section 15 forms a longitudinal open slot 19, while closed section 17 forms a closed longitudinal slot 21, with at least slot 21 being provided with at least one open end. Slot 19 includes a longitudinal rear wall 23 that is provided with a plurality of spaced apertures 25 along the length thereof, as more clearly shown in FIG. 3. Slot 21 is partially defined by a pair of inwardly directed longitudinal flanges 27 and 29 which terminate short of each other to form a longitudinal spacing 31 therebetween, the width of spacing 31 being slightly less than the thickness of the material forming bed 5 of hammock 1.

The manner in which hammock 1 is assembled by attaching heads 7 of bed 5 to support ropes 9 shall now be described with particular reference to FIGS. 4 and 5. FIG. 4 depicts, in fragmentary form, the underside of one end of hammock 1, but it is understood that the other end of hammock 1 shall have the same basic configuration.

The free ends of support ropes 9 are inserted through corresponding apertures 25 from the exterior side of longitudinal wall 23 and knotted, as generally shown at 31 for each single rope 9, and at 33 wherein the ends of two adjacent ropes 9 are tied together. It is understood that other knot configurations may also be utilized, or even separate appliances may be attached to the ends of ropes 9 to prevent their withdrawal from apertures 25.

Each head 7 may be formed by folding over and stitching the corresponding edge of bed 5, either to itself or to a separate length of hem material 35. In this way, head 7 is provided with a thickness which exceeds the thickness of bed 5. By virtue of this configuration, head 7 may therefore be longitudinally slid within closed slot 21, with the adjacent portion of bed 5 being disposed in spacing 31, as shown in FIG. 5.

It is therefore apparent from this arrangement, as shown in FIG. 5, that loading on bed 5, when hammock 1 is secured to its spaced supports, imparts oppositely directed tension forces to device 3, as indicated in the directions of arrows A and B. When this occurs, knots 31 and 33 of support ropes 9 are drawn inwardly into slot 19 for engagement against the interior side of longitudinal wall 23, thereby further strengthening and tightening knots 31 and 33 against their removal from apertures 25. Likewise, head 7 of bed 5 is pulled tightly against the inner wall surfaces adjacent the terminal edges of flanges 27 and 29, but its removal is prevented because its thickness exceeds the width of spacing 31. Thus, device 3 at both ends of hammock 1 becomes self-tightening, so that increased tension produces a tighter attachment of bed 5 and ropes 9 to device 3. The configuration of device 3 also serves to provide a uniform distribution of tension forces along the entire width of bed 5.

The invention therefore provides a device 3 of extremely simple configuration and construction for performing the dual function of attaching head 7 to support ropes 9 and maintaining head 7 in a spread condition through the use of a single device 3 at either end of bed 5. Other advantages of device 3 are also immediately apparent from the description herein. For example, the material forming device 3 may be varied in type and composition in order to impart a desired degree of flexibility so that an amount of swag in bed 5 may be realized during its use. There is now no need to form bed 5 with conventional metal grommets which tend to rust or tarnish, or possibly tear the fabric forming bed 5 during application of tension forces thereto. It is also now possible to quickly remove and replace bed 5 from device 3, a procedure which has heretofore required considerable labor effort in conventional hammock structures.

While device 3 has been shown in its preferred embodiment of use as part of a hammock structure, it is clearly within the purview of one of ordinary skill in the art to utilize device 3 in any other applications wherein it is desired to quickly and securely attach the thickened edge of a flexible sheet of material to a plurality of support ropes, such as in a trampoline structure.

The foregoing is considered as only illustrative of the basic principle of the present invention since numerous modifications and changes will readily be apparent to those skilled in the art. It is therefore not desired to limit the invention to the exact construction, composition of materials and mode of use shown and described, but that all suitable modfications and equivalents may be resorted to and falling within the scope of the invention as hereinafter claimed.

I claim:

1. A device for securing a flexible sheet of material having a head defined by a thickened edge to the ends of plural support members comprising:

(a) a substantially rigid elongate member;

(b) the transverse profile of the elongate member being defined by a base section, an open C-shaped section and a closed C-shaped section, which sections collectively form open and closed longitudinal slots along the length of the member;

(c) the open slot including a longitudinal rear wall provided with a plurality of spaced apertures therethrough for receiving the ends of the support members; and (d) the closed slot being further formed by a pair of inwardly directed longitudinal flanges having edges which terminate to define a longitudinal spacing therebetween, the spacing being dimensioned for receiving the sheet of material therein but preventing the head of the sheet from passing transversely therethrough.

2. The device of claim 1 wherein the elongate member is integrally formed from plastic material.

3. The device of claim 1 wherein the elongate member is integrally extruded from polyvinylchloride.

4. The device of claim 1 wherein each aperture in the rear wall is dimensioned to prevent the knotted end of a corresponding support member from being pulled therethrough.

5. The device of claim 1 wherein the transverse profile of the elongate member is uniform for the entire length of the member, with the first and second slots being open at their opposite ends.

6. The device of claim 1 wherein the C-shaped sections are carried on the base section and face the same direction.

7. A hammock comprising:

(a) a substantially rectangular-shaped bed formed from a sheet of flexible material, the opposed shorter edges of the bed being each thickened along the length thereof to define a head at each end of the bed;

(b) a pair of support means, each support means including a plurality of flexible elongate support members;

(c) a device for attaching each head of the bed to the support members of a corresponding support means; and (d) each device including a substantially rigid elongate member, the transverse profile of the elongate member being defined by a base section, an open C-shaped section and a closed C-shaped section, which sections collectively form open and closed longitudinal slots along the length of the member, the open slot including a longitudinal rear wall provided with a plurality of spaced apertures therethrough for receiving the ends of the support members, and the closed slot being further formed by a pair of inwardly directed longitudinal flanges having edges which terminate to define a longitudinal spacing therebetween, the spacing being dimensioned for receiving the sheet of material therein but preventing the head of the sheet from passing transversely therethrough.

8. The hammock of claim 7 wherein the elongate member is integrally formed from plastic material.

9. The device of claim 7 wherein the elongate member is integrally formed from plastic material.

10. The device of claim 7 wherein the elongate member is integrally extruded from polyvinylchloride.

11. The device of claim 7 wherein each aperture in the rear wall is dimensioned to prevent the knotted end of a corresponding support member from being pulled therethrough.

12. The device of claim 7 wherein the transverse profile of the elongate member is uniform for the entire length of the member, with the first and second slots being open at their opposite ends.

* * * * *